US008830282B2

(12) United States Patent
Leoni et al.

(10) Patent No.: US 8,830,282 B2
(45) Date of Patent: Sep. 9, 2014

(54) CHARGE SPREADING STRUCTURE FOR CHARGE-EMISSION APPARATUS

(75) Inventors: Napoleon J. Leoni, San Jose, CA (US); Henryk Birecki, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2263 days.

(21) Appl. No.: 11/770,655

(22) Filed: Jun. 28, 2007

(65) Prior Publication Data

US 2009/0002471 A1 Jan. 1, 2009

(51) Int. Cl.
*B41J 2/415* (2006.01)

(52) U.S. Cl.
CPC ..... *B41J 2/415* (2013.01)
USPC ..... 347/127; 347/123; 347/128

(58) Field of Classification Search
USPC ..... 347/127, 128, 123
See application file for complete search history.

(56) References Cited

U.S. PATENT DOCUMENTS

| | | | | |
|---|---|---|---|---|
| 3,789,471 | A | 2/1974 | Spindt et al. | |
| 4,155,093 | A | 5/1979 | Fotland | |
| 4,683,482 | A | 7/1987 | Inaba et al. | |
| 4,691,213 | A | 9/1987 | Inaba et al. | |
| 4,733,971 | A | 3/1988 | Pratt | |
| 4,773,971 | A | 9/1988 | Lam et al. | |
| 4,879,569 | A | 11/1989 | Kubelik | |
| 4,891,656 | A | 1/1990 | Kubelik | |
| 4,963,738 | A | 10/1990 | Gundlach et al. | |
| 5,027,136 | A * | 6/1991 | Fotland et al. | 347/127 |
| 5,177,503 | A | 1/1993 | Kubelik | |
| 5,278,588 | A | 1/1994 | Kubelik | |
| 5,315,324 | A | 5/1994 | Kubelik et al. | |
| 5,646,669 | A * | 7/1997 | Yamada et al. | 347/127 |
| 5,886,723 | A | 3/1999 | Kubelik et al. | |
| 6,239,823 | B1 | 5/2001 | Fotland | |
| 6,362,574 | B1 * | 3/2002 | Aguero et al. | 315/169.3 |
| 6,386,684 | B1 | 5/2002 | Brennan et al. | |
| 6,741,017 | B1 | 5/2004 | Ide et al. | |
| 6,812,634 | B2 * | 11/2004 | Murakami et al. | 313/495 |
| 7,209,154 | B2 | 4/2007 | Matsuzoe | |
| 2002/0167579 | A1 * | 11/2002 | Kubelik | 347/127 |
| 2005/0078153 | A1 * | 4/2005 | Murai et al. | 347/68 |

FOREIGN PATENT DOCUMENTS

| | | | |
|---|---|---|---|
| JP | 8129292 | A | 5/1996 |

* cited by examiner

*Primary Examiner* — Sarah Al Hashimi

(57) ABSTRACT

An apparatus includes a generator electrode, a discharge electrode that has an aperture, a dielectric structure between the generator electrode and the discharge electrode, and a charge spreading structure. The dielectric structure includes a charging region under the aperture. The charge spreading structure is on a surface of the charging region facing the aperture. The charge spreading structure is electrically disconnected from the generator electrode and the discharge electrode and spreads electrical charge carriers over underlying areas of the charging region.

20 Claims, 5 Drawing Sheets

CHARGE SPREADING STRUCTURE FOR CHARGE-EMISSION APPARATUS

CROSS-REFERENCE TO RELATED APPLICATIONS

This application also relates to co-pending U.S. patent application Ser. No. 11/699,720, filed Jan. 29, 2007, which is incorporated herein by reference.

BACKGROUND

Charge emission apparatus are used in a wide variety of different applications. For example, charge deposition print heads are used in electrostatic imaging apparatus to form an electrostatic latent image on a dielectric imaging surface by directing beams of charged particles onto the imaging surface. The electrostatic latent image is developed into a visible image using electrostatic toners or pigments, which are selectively attracted to the electrostatic latent image on the imaging surface. In such charge deposition print heads, an RF signal of up to several thousand volts is applied across a plurality of pairs of generator electrodes and discharge electrodes that are separated by an electrical insulator. The generator electrodes and the discharge electrodes typically are arranged orthogonally to one another. The applied signal creates localized charge source regions located at or near crossing points between the generator electrodes and the discharge electrodes. Electrical air gap breakdown between the discharge electrode and the electrical insulator generates electrical charge carriers that are emitted through apertures in the discharge electrodes and directed toward the imaging surface where the charges are deposited. The print heads are configured so that the charge deposited by each aperture forms a pixel or dot-like latent charge image on the imaging surface as it moves past the print head.

In general, there is a continuing push to increase the speed and the spatial resolution at which charge emission apparatus can deposit charge. Increasing the charge emission speed requires a linear increase in the required charging current. Increasing the spatial resolution, on the other hand, requires reducing the size of the discharge electrode aperture, which results in a concomitant decrease in the charging current. For high resolution electrostatic printing applications, an additional screen electrode aperture is needed to focus the charged particles. Such a screen electrode aperture imposes an additional decrease of up to 50% to 75% in the current depending on the extracting field. Attempts to increase charge deposition speed and spatial resolution by increasing the charging current oftentimes fail due to thermal failures and loss of reliability of the charge emitting printhead.

What are needed are improved charge-emission apparatus that are capable of emitting charged particles at a high rate and a high spatial resolution.

SUMMARY

In one aspect, the invention features an apparatus that includes a generator electrode, a discharge electrode that has an aperture, a dielectric structure between the generator electrode and the discharge electrode, and a charge spreading structure. The dielectric structure includes a charging region under the aperture. The charge spreading structure is on a surface of the charging region facing the aperture. The charge spreading structure is electrically disconnected from the generator electrode and the discharge electrode and spreads electrical charge carriers over underlying areas of the charging region.

In another aspect, the invention features an apparatus that includes an imaging member and a charge deposition print head. The imaging member includes an outer imaging surface. The charge deposition print head includes an array of charge-emission sites each of which includes a generator electrode, a discharge electrode that has an aperture, a dielectric structure between the generator electrode and the discharge electrode, and a charge spreading structure. The dielectric structure includes a charging region under the aperture. The charge spreading structure is on a surface of the charging region facing the aperture. The charge spreading structure is electrically disconnected from the generator electrode and the discharge electrode and spreads electrical charge carriers over underlying areas of the charging region. The print head is configured to direct a stream of charge carriers from the at least one discharge aperture to the imaging surface and thereby form an electrostatic latent image on the imaging surface.

In another aspect, the invention features a method in accordance with which a generator electrode is provided on a first surface of a dielectric structure. A discharge electrode is provided on a second surface of the dielectric structure opposite the first surface. The discharge electrode has an aperture. The dielectric structure comprises a charging region under the aperture. A charge spreading structure is formed on a surface of the charging region facing the aperture. The charge spreading structure is electrically disconnected from the generator electrode and the discharge electrode and spreads electrical charge carriers over underlying areas of the charging region.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

I. Introduction

Figure 1:
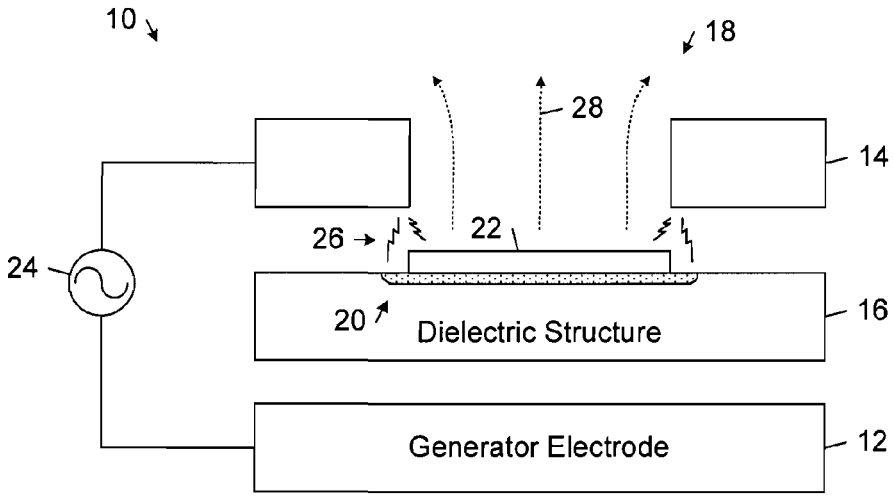
FIG. 1 is a block diagram of an embodiment of a charge-emission apparatus that includes a generator electrode, a discharge electrode, and a dielectric structure.

FIG. 1 shows an embodiment of a charge-emission apparatus 10 that includes a generator electrode 12, a discharge electrode 14, and a dielectric structure 16 between the generator electrode 12 and the discharge electrode 14. The discharge electrode 14 has an aperture 18. The dielectric structure 16 includes a charging region 20 under the aperture 18. The charge-emission apparatus 10 additionally includes a charge spreading structure 22 on a surface of the charging region that faces the aperture 18. The charge spreading structure 22 is electrically disconnected from the generator electrode 12 and the discharge electrode 14.

The discharge electrode 14 typically is formed of steel or a refractory metal (e.g., tungsten, molybdenum, tantalum, niobium, and chromium) or a metal alloy. The aperture 18 typically is circular in shape and is located over the generator electrode 12. The generator electrode 12 may be formed of a wide variety of different materials, including but not limited to a metal (e.g., gold, copper, tungsten, molybdenum, tantalum, niobium, and chromium) and a metal alloy.

The dielectric structure 16 typically is formed of one or more electrically insulating layers. In some exemplary embodiments, the dielectric structure 16 is formed of one or more layers of mica, glass, or silicone. The thickness of the dielectric structure 16 typically is on the order of 25 micrometers (μm). Assuming that such a dielectric structure has a dielectric constant of 5, the equivalent electrical thickness of the dielectric structure 16 is about 5 μm.

The charge spreading structure 22 includes electrically conducting material that spreads electrical charge carriers over the underlying areas of the charging region 20. The charge spreading structure 22 may include one or more layers of any of a wide variety of different electrically conducting materials, including but not limited to a metal (e.g., aluminum, copper, tungsten, molybdenum, tantalum, niobium, chromium, zinc, platinum, titanium, or gold), a metal alloy, an electrically conducting oxide (e.g., tin oxide or indium-tin-oxide), and an electrically conducting semiconductor material (e.g., a doped semiconductor, such as germanium, silicon, and gallium arsenide).

In some embodiments, the charge spreading structure 22 is a multilayer structure that includes at least one adhesion layer and at least one overlaying layer. The adhesion layer typically is formed of a material (e.g., titanium or chromium) that promotes adhesion of the overlying layer to the surface of dielectric structure 16. The overlying layer typically is formed of a material that has one or more properties that protect or enhance the operation of the charge-emission apparatus. For example, in some embodiments, the overlying layer is formed of one or more of platinum, and gold, to provide a chemically inert surface that resists the formation of oxides that otherwise might impede charge re-distribution. In some embodiments, the overlying layer is formed of one or more of rhodium and platinum to provide catalytic properties that resist the formation of deposits (e.g., nitrogen-based deposits) on the surface. In some embodiments, the overlying layer is formed of one or more of tungsten, molybdenum, tantalum, niobium, and chromium to provide a surface that is resistant to sputtering by ion bombardment. In some embodiments, the overlying layer is formed of a material, such as zinc or tantalum, which has a small work function and may thereby enhance charge emission.

In some embodiments, the charge spreading structure 22 includes charge-emitting surface features that increase the emission of charge carriers into the aperture 18. In some of these embodiments, the surface features correspond to rough surface areas of an electrically conducting material that is deposited on the dielectric structure 16 using a deposition process (e.g., a chemical vapor deposition (CVD) process or a sputtering process) that is configured to produce a rough surface. In other ones of these embodiments, the surface features correspond to protrusions that extend toward the aperture 18. In some embodiments, the protrusions are sharp cone-shaped or needle-shaped protuberances that are formed on one or more layers of electrically conducting material in accordance with one or more of the processes described in U.S. Pat. Nos. 3,789,471 and 6,362,574. In other embodiments, the protrusions are nanotubes that are formed on one or more layers of electrically conducting material in accordance with one or more of the processes described in U.S. Pat. Nos. 6,812,634 and 6,741,017.

In operation, a voltage source 24 applies a radio frequency (RF) voltage signal across the generator electrode 12 and the discharge electrode 14. Charge carriers initially are generated when the electric field between the discharge electrode 14 and the dielectric structure 16 reaches the minimum Paschen breakdown electric field strength for the ambient pressure. The initiating event in the discharge process 26 typically involves field emission of an electron from the discharge electrode 14 at a location where the gap between the discharge electrode 14 and the dielectric structure 16 is smallest. The charge carrier generation process 26 continues through avalanche charge multiplication even at lower electric field strengths. The electrical breakdown causes a gaseous plasma of charged particles 28 (i.e., ions and electrons) to form. The charged particles 28 escape through the aperture 18.

During the charge carrier generation process 26, the charge spreading structure 22 spreads electrical charge carriers (shows diagrammatically as dots in the charging region 20) over underlying areas of the charging region 20. By redistributing charge carriers away from the minima in the gap between the discharge electrode 14 and the dielectric structure 16, the charge spreading structure 22 allows more charge to be stored in the dielectric structure 16 and the plasma filled space between the dielectric structure 16 and the discharge electrode 14 per RF cycle and thereby increases the current levels that can be generated by the charge-emission apparatus 10 for a given RF voltage swing. In addition, by providing an equipotential surface region, the charge spreading structure 22 couples the electric fields from the generator electrode 12 more efficiently into the charged space above the charge spreading structure 22, thereby facilitating ejection of charge from that space through the discharge electrode aperture 18. In this way, embodiments of the charge-emission apparatus 10 are capable of producing charge particle emission at both a high rate and a high spatial resolution.

Figure 2:
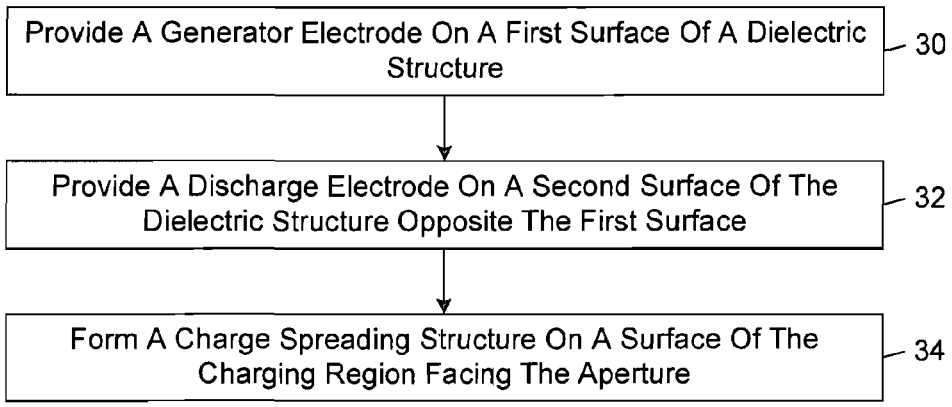
FIG. 2 is a flow diagram of an embodiment of a method of producing the charge-emission apparatus of FIG. 1.

FIG. 2 shows an embodiment of a method of producing the charge-emission apparatus 10. In accordance with this embodiment, the generator electrode 12 is provided on a first surface of the dielectric structure 16 (FIG. 2, block 30). The discharge electrode 14 is provided on a second surface of the dielectric structure 16 opposite the first surface (FIG. 2, block 32). The charge spreading structure 22 is formed on a surface of the charging region 20 facing the aperture 18 (FIG. 2, block 34).

II. Exemplary Charge-Emission Apparatus Embodiments

Figure 3:
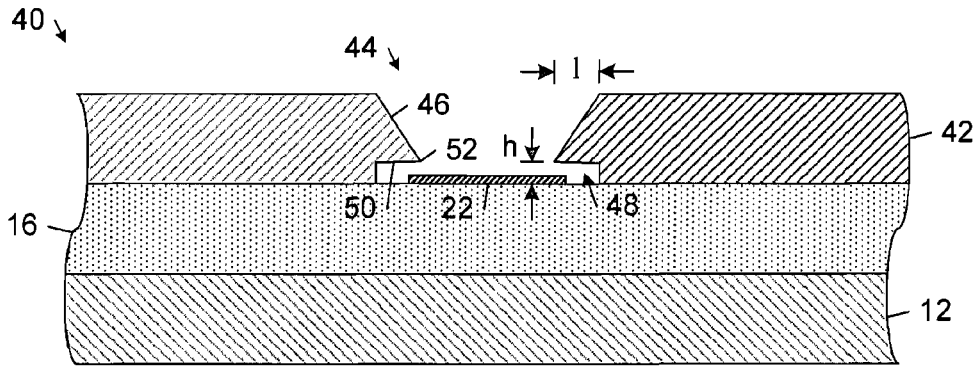
FIG. 3 is a diagrammatic side view of an embodiment of an embodiment of the charge-emission apparatus shown in FIG. 1.

FIG. 3 shows an embodiment 40 of the charge-emission apparatus 10 that includes a discharge electrode 42 that has a conically tapered aperture 44. The aperture 44 is defined by tapered side walls 46 overlying an undercut region 48. The undercut region 48 is defined by a discharge surface 50 that is parallel to the top surface of the dielectric structure 16 and spaced from the top surface of the dielectric structure 16 by a distance h. The undercut region 48 extends a distance l under the discharge electrode 42.

The distance (h) between the discharge surface and the underlying top surface of the dielectric structure 16 typically corresponds to the smallest distance separating the discharge electrode 42 from the dielectric structure 16 and therefore corresponds to the location where the highest electrical field strengths are produced during operation. In some embodiments, the distance h is set equal to the Paschen minimum gap distance for a specified ambient pressure level at which the charge-emission apparatus 40 will be operated. For example, with a specified operating ambient pressure level equal to atmospheric pressure, the distance h is set to 4 μm. In some embodiments, the distance l is approximately equal to or greater than the distance h. Thus, in these embodiments, if the distance h is 4 μm, the distance l is set to be at least about 4 μm.

In some embodiments, the undercut region 48 is formed by selectively etching the discharge electrode 42 using, for example, a wet chemical etching process or a plasma etching process. In other embodiments, the undercut region 48 of the discharge electrode 42 is formed using a stepped mandrel. For example, in some of these embodiments, the spacing distance h and the extension distance l are controlled by a stepped mandrel in accordance with the electroforming process as described in U.S. Pat. No. 4,733,971. Electroforming beneficially allows the aperture 44 to by made with a small diameter (e.g., on the order of about 13 μm) and a repeatable breakdown geometry due to the tight control over the spacing distance h of the undercut in region 48 and the creation of a sharp edge or corner 52 around the perimeter of the aperture 44 that increases the probability that a discharge event will start once the minimum Paschen electric field strength is reached.

In some embodiments, the charge spreading structure 22 is formed at least in part by self-aligned deposition of an electrically conducting material (e.g., a metal, such as tantalum, platinum, niobium, or zinc) through the aperture 44. In this process, the material is deposited on the discharge electrode 42 and the unmasked portion of the top surface of the dielectric structure 16 that is exposed through the aperture 44. In some embodiments, during processing the deposited material migrates sideways onto portions of the top surface of the dielectric structure 16 in the undercut region 48. After the electrically conducting material has been deposited onto the dielectric structure 16, additional surface features (e.g., cone-shaped or needle-shaped protrusions or nanotubes) may be formed on the electrically conducting material to enhance charge particle emission into the aperture region.

FIGS. 4-7 show alternative embodiments of the charge-emission apparatus 10 that include different configurations of the discharge electrode 14.

Figure 4:
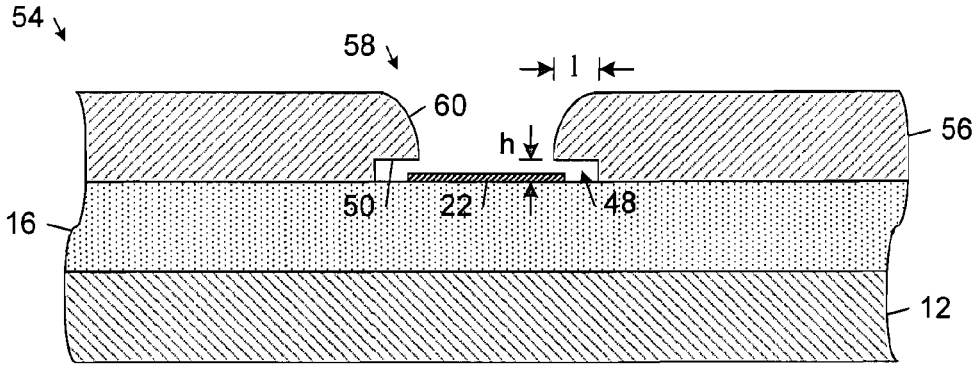
FIG. 4 is a diagrammatic side view of an embodiment of an embodiment of the charge-emission apparatus shown in FIG. 1.

FIG. 4 shows an embodiment 54 of the charge-emission apparatus 10 that corresponds to the charge-emission apparatus 40 except the charge-emission apparatus 54 includes a discharge electrode 56 that has an aperture 58 defined by curved sidewalls 60.

Figure 5:
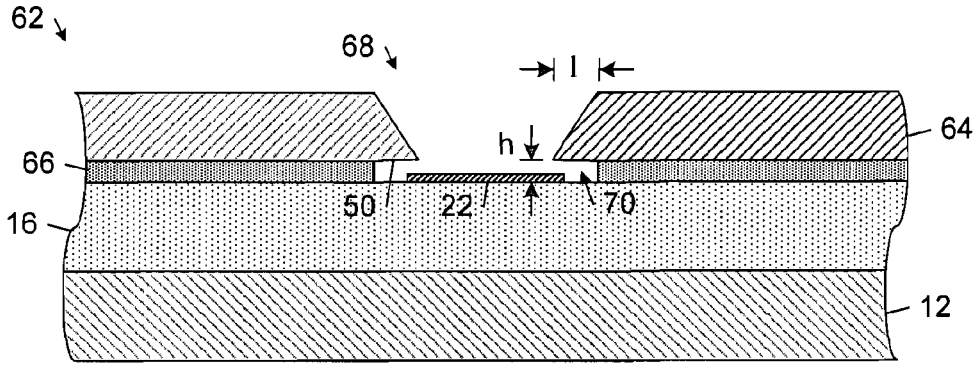
FIG. 5 is a diagrammatic side view of an embodiment of an embodiment of the charge-emission apparatus shown in FIG. 1.

FIG. 5 shows an embodiment 62 of the charge-emission apparatus 10 that corresponds to the charge-emission apparatus 40 (see FIG. 4) except the charge-emission apparatus 62 includes a discharge electrode 64 that is formed on a spacer layer 66. The spacer layer 66 has an aperture that is larger than the aperture 68 through the discharge electrode 64 such that an undercut region 70 is formed between the discharge electrode 64 and the dielectric structure 16. In some embodiments, the spacer layer 66 is formed of an insulator (e.g., an etched photoresist film) or a metal foil.

Figure 6:
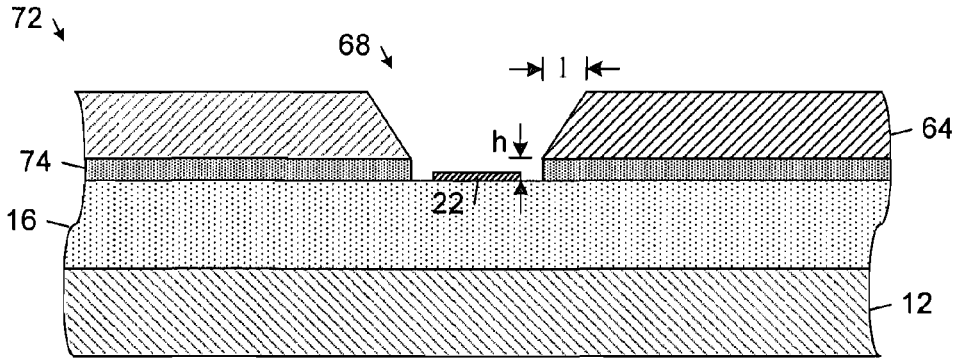
FIG. 6 is a diagrammatic side view of an embodiment of an embodiment of the charge-emission apparatus shown in FIG. 1.

FIG. 6 shows an embodiment 72 of the charge-emission apparatus 10 that corresponds to the charge-emission apparatus 62 (see FIG. 5) except the charge-emission apparatus 72 does not include an undercut region between the discharge electrode 64 and the dielectric structure 16. Instead, the discharge electrode 64 is formed on a spacer layer 74 that has an aperture with a diameter that is substantially the same as the bottom diameter of the aperture 68 through the discharge electrode 64. In some embodiments, the spacer layer 74 is formed of an insulator (e.g., an etched photoresist film) or a metal foil. In this embodiment, the charge spreading structure 22 may be using photolithographic patterning processes (e.g., etching and liftoff processes).

Figure 7:
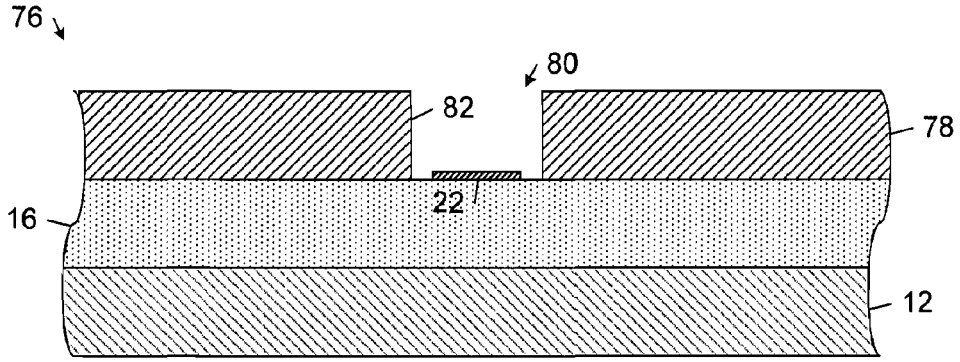
FIG. 7 is a diagrammatic side view of an embodiment of an embodiment of the charge-emission apparatus shown in FIG. 1.

FIG. 7 shows an embodiment 76 of the charge-emission apparatus 10 that corresponds to the charge-emission apparatus 40 (see FIG. 4) except the charge-emission apparatus 76 includes a discharge electrode 78 that has an aperture 80 defined by vertical (not tapered) side walls 82 and that does not have an undercut region. In this embodiment, the charge spreading structure 22 may be formed using photolithographic patterning processes (e.g., etching and liftoff processes).

Figure 8:
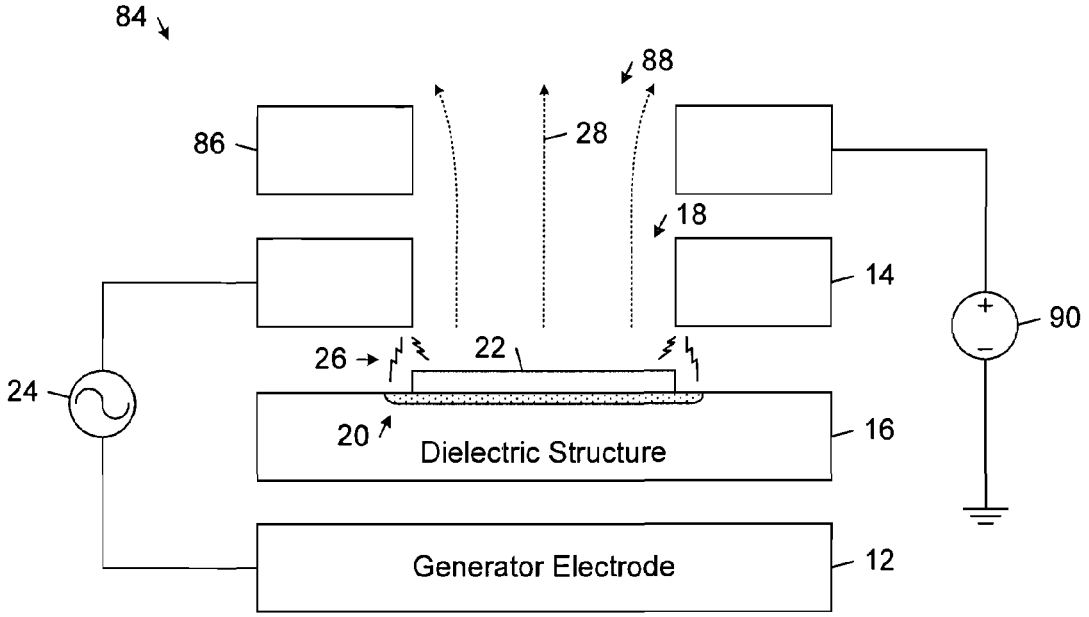
FIG. 8 is a diagrammatic view of an embodiment of the charge-emission apparatus of FIG. 1 that includes a screen electrode.

FIG. 8 shows an embodiment 84 of the charge-emission apparatus 10 that additionally includes a screen electrode 86 that has an aperture 88 that is axially aligned with the aperture 18 of the discharge electrode 14. The screen electrode 86 is electrically isolated from the generator electrode 12 and the discharge electrode 14. In operation, the screen electrode 86 is connected electrically to a voltage source 90, which biases the screen electrode 86. The voltage difference between the screen electrode 86 and the target of the charge particle emission determines the polarity of the particles that are emitted from the charge-emission apparatus 84, whereas the voltage difference between the screen electrode 86 and the discharge electrode 14 regulates the emission of charged particles from the charge emission apparatus 84 (e.g., turns the charged particle emission on and off).

III. Exemplary charge-emission apparatus application Environment

In general, the charge-emission apparatus 10 may be used in a wide variety of different application environments. In some exemplary embodiments, the charge-emission apparatus 10 is incorporated in a charge-deposition print head for electrostatic imaging applications.

Figure 9:
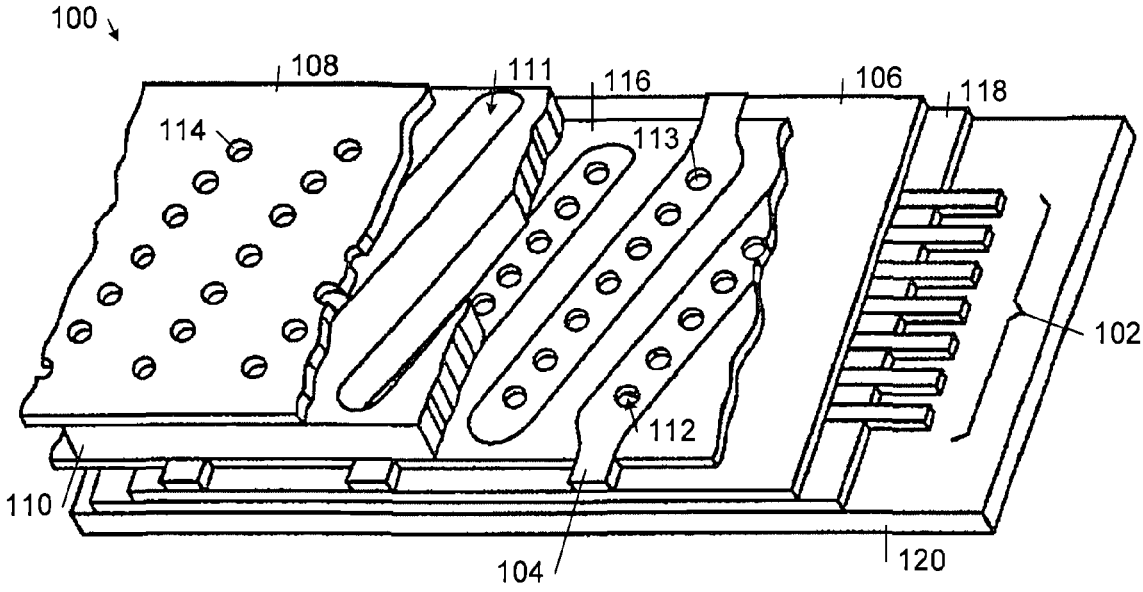
FIG. 9 is a diagrammatic perspective view of an embodiment of an electrostatic print head that includes an embodiment of the charge-emission apparatus of FIG. 1.

FIG. 9 shows a portion of an exemplary charge deposition print head 100 that includes a plurality of generator electrodes 102 in a first layer, and a plurality of discharge electrodes 104 in a second layer, where the generator electrodes 102 are separated from the discharge electrodes 104 by a dielectric structure 106. An exemplary dielectric structure 106 is formed of one or more layers of mica, glass, or silicone. In one exemplary embodiment, the dielectric structure has a thickness that is on the order of 25 μm. An optional screen electrode 108 is isolated from the discharge electrodes 104 by a spacer layer 110 that includes a series of slots 111 that are aligned with respective ones of the discharge electrodes 104. Each of the discharge electrodes 104 has a respective set of discharge apertures 112 that are axially aligned with apertures 114 in the screen electrode 108. The discharge apertures 112 typically are circular in shape. The generator electrodes 102 intersect the discharge electrodes 104 at locations under the discharge apertures 102. A respective charge-emission site is formed under each of the discharge apertures 112. The charge spreading structures located at 113 are visible through the discharge apertures 112. The spaces between adjacent ones of the generator electrodes 102 typically are filled by a dielectric material 118 (e.g., spin on glass (SOG)). Similarly, the spaces between adjacent ones of the discharge electrodes 104 typically are filled by a dielectric material 116 (e.g., spin on glass (SOG)). The generator electrode assembly, the dielectric structure, and the discharge electrode assembly typically are supported by a substrate 120 (e.g., a printed circuit board substrate).

Figure 10:
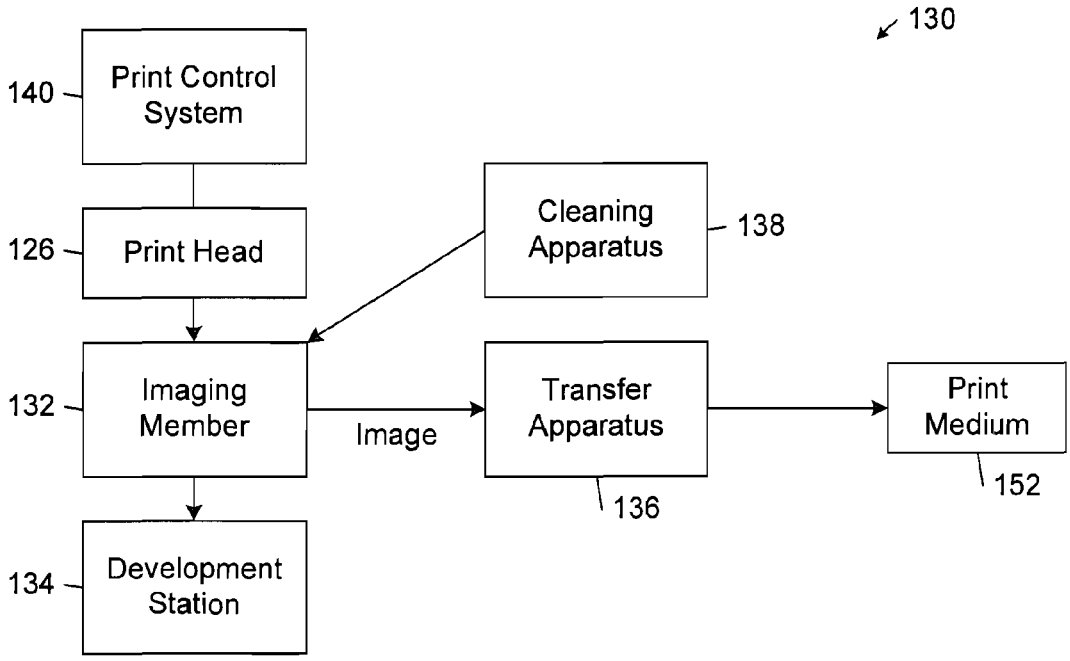
FIG. 10 is a block diagram of an embodiment of an image transfer apparatus.
Figure 11:
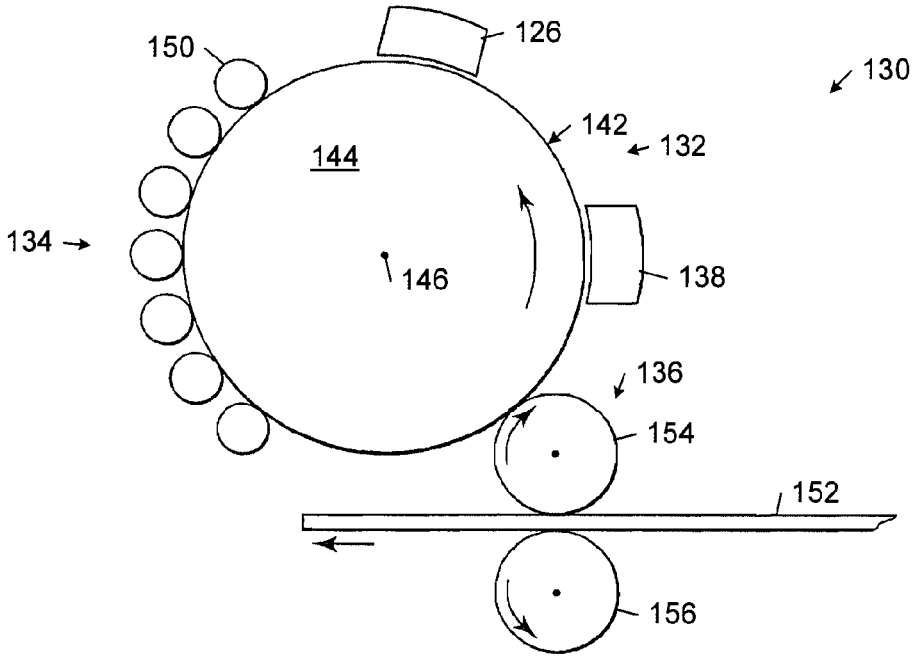
FIG. 11 is a diagrammatic side view of an embodiment of the image transfer apparatus of FIG. 10.

FIGS. 10 and 11 show an exemplary embodiment of an image transfer apparatus 130 that incorporates one or more charge deposition print heads 126 of the type shown in FIG. 9. As used herein, the term "image transfer apparatus" generally refers to all types of apparatus that are used for creating and/or transferring an image in an electrostatic imaging process (also referred to as ion deposition printing, charge deposition printing, ionography, electron beam imaging, and digital lithography, for example). Such image transfer apparatus may include, for example, laser printers, copiers, facsimiles, and the like. The depicted image transfer apparatus 130 includes an imaging member 132, the charge deposition print head 126, a development station 134, an image transfer apparatus 136, and a cleaning apparatus 138. The print head 126 is controlled by a print control system 140.

Referring to FIG. 11, the imaging member 132 is implemented by a drum 144 that rotates about an axis 146. The imaging member 132 includes an outer imaging surface 142 that rotates past the print head 126, the development station 134, the image transfer apparatus 136, and the cleaning apparatus 138.

The print head 126 deposits an electrostatic latent image on the imaging surface 142 of the imaging member 132. In one implementation, the print head 126 forms electrostatic latent images on imaging surface 142 for each color of a specified color space (e.g., yellow (Y), magenta (M), cyan (C) and black (K) in the CMYK color space).

The development station 134 applies a marking agent (e.g., liquid ink or dry toner) to the imaging surface 142. The marking agent selectively adheres to the imaging surface 142 in accordance with the electrostatic charges that were deposited on the imaging surface 142 to form a visible toner image on imaging surface 142. In the illustrated embodiment, the development station 134 includes a plurality of development rollers 150 that apply different respective marking agent colors to the imaging surface 142.

The image transfer apparatus 130 transfers the marking agents in the developed image to a print medium 152 (e.g., paper). In one embodiment, the image transfer apparatus 130 includes an intermediate transfer drum 154 that contacts the imaging surface 142, and a fixation or impression drum 156 that defines a nip with the transfer drum 154. As the transfer drum 154 is brought into contact with the imaging surface 142, the marking agent is transferred from imaging surface 142 to the transfer drum 154. As the print medium 152 is fed into the nip between the transfer drum 154 and the impression drum 156, the marking agent is transferred from the transfer drum 154 to the print medium 152. The impression drum 156 fuses the toner image to the print medium 152 by applying heat and pressure.

Before the print head 126 applies charge to the image surface 142, the cleaning apparatus 138 removes any residual marking agent that was not transferred from the imaging surface 142 to the transfer drum 154.

Figure 12:
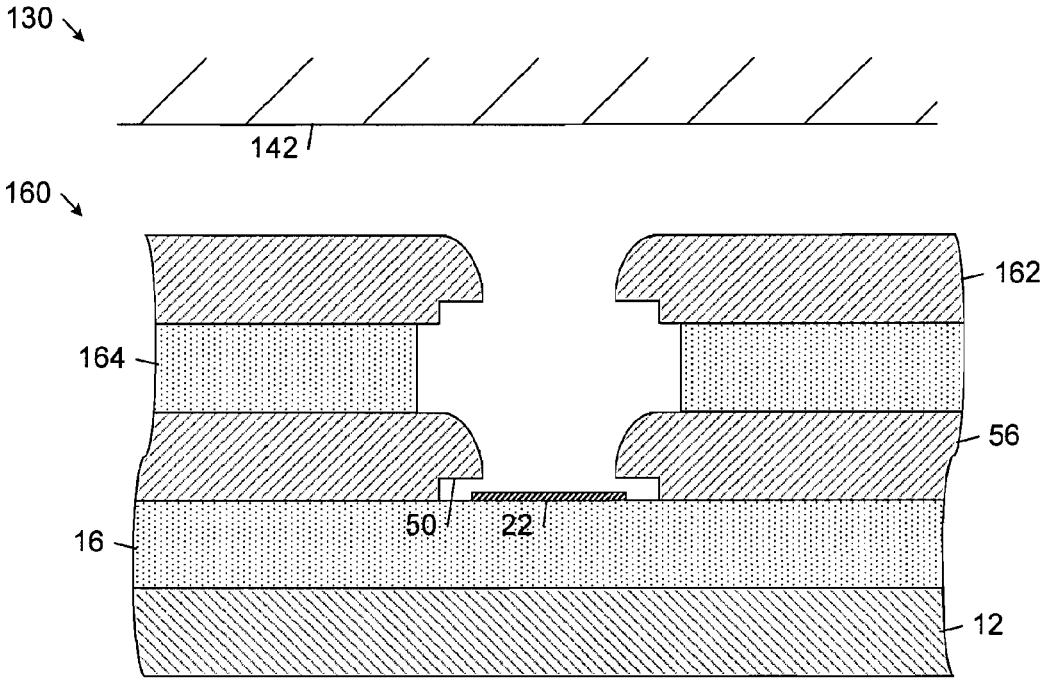
FIG. 12 is a cross-sectional side view of an embodiment of a charge-emission site of an electrostatic print head adjacent an imaging surface of the image transfer apparatus of FIG. 11.

FIG. 12 shows a charge-emission site 160 of an embodiment of the print head 126 positioned adjacent to the imaging surface 142 in an embodiment of the image transfer apparatus 130. The charge-emission site 160 corresponds to an embodiment of the charge-emission apparatus 10 that includes a screen electrode 162 and an electrically insulating spacer 164. As explained above, the screen electrode 162 is biased electrically in a way that accelerates the charged particles toward the imaging surface 142 and focuses the charged particle beam onto a small deposition area on the image surface 142. The charge spreading structure 22 increases the efficiency with which charged particles are generated by spreading the electrical charge carriers over a larger area of the underlying surface of the dielectric structure 16 than otherwise would be the case if the charge spreading structure was not present.

IV. Conclusion

The embodiments that are described herein incorporate a charge spreading structure that spreads electrical charge carriers over underlying areas of a charging region during the charge carrier generation process 26. By redistributing charge carriers away from the minima in the gap between a discharge electrode and a dielectric structure, the charge spreading structure allows more charge to be stored in the dielectric structure per RF cycle and thereby increases the current levels that can be generated by the charge-emission apparatus 10 for a given RF voltage swing. In this way, these embodiments are capable of producing charge particle emission at both a high rate and a high spatial resolution.

Other embodiments are within the scope of the claims.

What is claimed is:

1. An apparatus, comprising:

a generator electrode;

a discharge electrode having an aperture;

a dielectric structure between the generator electrode and the discharge electrode, wherein the dielectric structure comprises a charging region under the aperture; and an electrically conductive charge spreading structure on a surface of the dielectric structure above the charging region, wherein the charge spreading structure comprises a top surface that faces the aperture and lateral edges that extend from the top surface to the surface of the dielectric structure, the top surface and the lateral edges are exposed to ambient pressure conditions, and the charge spreading structure is electrically isolated from the generator electrode and the discharge electrode.

2. The apparatus of claim 1, wherein the charge spreading structure comprises electrically conducting material that spreads electrical charge carriers over underlying areas of the charging region.

3. The apparatus of claim 2, wherein the electrically conducting material comprises a metal layer.

4. The apparatus of claim 3, wherein the metal layer comprises a metal selected from the group consisting of tantalum, niobium, platinum, titanium, and zinc.

5. The apparatus of claim 2, wherein the electrically conducting material comprises a material selected from the group consisting of an electrically conducting oxide and an electrically conducting semiconductor material.

6. The apparatus of claim 1, wherein the charge spreading structure comprises charge-emitting surface features.

7. The apparatus of claim 6, wherein the charge-emitting surface features comprise rough surface areas of an electrically conducting material.

8. The apparatus of claim 6, wherein the charge-emitting surface features comprise protrusions extending toward the aperture.

9. The apparatus of claim 6, wherein the charge-emitting surface features comprise nanotubes.

10. The apparatus of claim 1, wherein the charge-spreading structure comprises an adhesion layer on the surface of the charging region and at least one overlying structure on the adhesion layer.

11. The apparatus of claim 10, where the adhesion layer comprises at least one material selected from titanium and chromium, and the overlying structure comprises at least one material selected from tantalum, platinum, gold, niobium, and zinc.

12. The apparatus of claim 1, wherein the generator electrode, the discharge electrode, the dielectric structure, and the charge spreading structure collectively form a first charge-emission site, and further comprising a plurality of copies of the charge-emission site arranged in an array with the first charge-emission site.

13. The apparatus of claim 1, wherein the discharge electrode comprises a discharge surface structure that faces the dielectric structure and extends over the lateral edges and peripheral portions of the top surface of the charge spreading structure.

14. The apparatus of claim 13, wherein the discharge electrode comprises a side wall structure that defines with the discharge surface structure an undercut region between the side wall structure and the charge spreading structure.

15. The apparatus of claim 14, wherein the side wall structure of the discharge electrode is laterally adjacent and spaced from the lateral edges of the charge spreading structure.

16. The apparatus of claim 15, wherein spacing between the side wall structure of the discharge electrode and the lateral edges of the charge spreading structure is at least equal to spacing between the discharge surface structure and the dielectric structure.

17. An apparatus, comprising:

an imaging member including an outer imaging surface;

a charge deposition print head comprising an array of charge-emission sites each comprising a generator electrode, a discharge electrode having an aperture, a dielectric structure between the generator electrode and the discharge electrode, wherein the dielectric structure comprises a charging region under the aperture, and an electrically conductive charge spreading structure on a surface of the dielectric structure above the charging region, wherein the charge spreading structure comprises a top surface that faces the aperture and lateral edges that extend from the top surface to the surface of the dielectric structure, the top surface and the lateral edges are exposed to ambient pressure conditions, and the charge spreading structure is electrically isolated from the generator electrode and the discharge electrode;

wherein the print head is configured to direct a stream of charge carriers from the at least one discharge aperture to the imaging surface and thereby form an electrostatic latent image on the imaging surface.

18. The image transfer apparatus of claim 17, wherein the imaging member is configured to move the imaging surface past the print head.

19. The image transfer apparatus of claim 18, further comprising a transfer apparatus configured to transfer the marking agent of the developed image from the imaging surface to a print medium.

20. The image transfer apparatus of claim 17, further comprising a development station configured to develop the electrostatic latent image on the imaging surface using a marking agent.

* * * * *